US006178926B1

(12) United States Patent
Worman

(10) Patent No.: US 6,178,926 B1
(45) Date of Patent: Jan. 30, 2001

(54) DOUBLE-FIRED HORIZONTAL TUBE HEATER

(75) Inventor: Donald D. Worman, Perkasie, PA (US)

(73) Assignee: Foster Wheeler Corporation, Clinton, NJ (US)

( * ) Notice: Under 35 U.S.C. 154(b), the term of this patent shall be extended for 0 days.

(21) Appl. No.: 09/387,269

(22) Filed: Aug. 31, 1999

(51) Int. Cl.[7] ..... F22B 37/24; C10G 9/20

(52) U.S. Cl. ..... 122/510; 122/247; 196/110; 202/237; 208/131

(58) Field of Search ..... 122/240.1, 247, 122/510; 196/110; 202/237; 208/131

(56) References Cited

U.S. PATENT DOCUMENTS

| | | | | |
|---|---|---|---|---|
| 2,456,787 | | 12/1948 | Kniel | 196/110 |
| 3,230,052 | | 1/1966 | Lee et al. | 23/277 |
| 3,265,043 | | 8/1966 | Lee et al. | 122/360 |
| 3,292,599 | | 12/1966 | Zimmerman | 122/510 |
| 3,302,621 | | 2/1967 | Klein | 122/510 |
| 3,348,923 | | 10/1967 | Demarest | 23/288 |
| 3,384,053 | | 5/1968 | Fleischer | 122/510 |
| 3,554,168 | | 1/1971 | Woebcke | 122/510 |
| 3,630,176 | * | 12/1971 | Sato et al. | 122/356 |
| 3,667,429 | * | 6/1972 | Cross | 122/240 B |
| 3,720,259 | * | 3/1973 | Fritz et al. | 165/162 |
| 4,013,024 | | 3/1977 | Kochey, Jr. et al. | 110/98 R |
| 4,019,468 | * | 4/1977 | Miles | 122/510 |
| 4,480,594 | | 11/1984 | Sullivan et al. | 122/510 |
| 4,706,614 | | 11/1987 | Fournier et al. | 122/510 |
| 4,955,323 | | 9/1990 | Ziemianek | 122/4 D |
| 5,078,857 | | 1/1992 | Melton | 208/132 |
| 5,394,837 | * | 3/1995 | Tsai et al. | 122/235.23 |
| 5,799,623 | * | 9/1998 | Born et al. | 122/510 |

* cited by examiner

*Primary Examiner*—Bekir L. Yildirim
(74) *Attorney, Agent, or Firm*—Fitzpatrick, Cella, Harper & Scinto

(57) ABSTRACT

A heater includes a radiant section having a wall and a roof, the roof having a longitudinal opening. A radiant heat exchange tube is disposed in the radiant section, and the tube has an inlet and outlet through which a process fluid can be carried respectively into and out of the radiant section. The tube between the inlet and outlet is arranged in generally horizontal tube lengths. A plurality of burners is provided, at least two of the burners being disposed on opposing sides of the tube. A plurality of tube supports is releasably positioned at longitudinal intervals along the tube lengths and define tube seats on which the tube lengths rest. The tube and tube supports are liftable as a unit through the longitudinal opening of the roof of the radiant section.

19 Claims, 4 Drawing Sheets

DOUBLE-FIRED HORIZONTAL TUBE HEATER

FIELD OF THE INVENTION

The present invention relates to double-fired heaters having a radiant heat exchange tube supported in horizontal lengths by a tube support, and more particularly to such a heater having design features that simplify replacement of the tube and tube support.

BACKGROUND OF THE INVENTION

In a double-fired heater, at least one heat exchange tube, which carries a process fluid (liquid or gas), is heated by combustion from two opposing sides of the tube in a radiant section of the heater. This invention relates to a subclass of such heaters, which will be referred to as "horizontal tube heaters," in which the tube (or tubes) winds back and forth in horizontal lengths to form a coil panel (or panels). The coil panel is supported within the radiant section by tube supports. Horizontal tube heaters are used in such processes as "cracking" ethylene dichloride (EDC) into vinyl chloride for use as fibers and plastics (such a heater is referred to as an EDC furnace), vaporizing sulfur in petrochemical applications, heating coking feedstock, and the like. One example of a horizontal tube heater, used for heating coking feedstock, is illustrated in U.S. Pat. No. 5,078,857, to Melton.

As a practical matter, most horizontal tube heaters will contain a convection section in addition to the radiant section. In the convection section, which is employed downstream and at a higher elevation than the radiant section, a convective tube coil (or coils) is exposed to a flow of hot exhaust from combustion in the radiant section.

In many horizontal tube heater applications, such as those mentioned above, the tube and tube supports are subjected to harsh operating or environmental conditions. These conditions can lead to significant corrosion, and wear and tear on the tube and supports, requiring the tube and/or supports to be periodically replaced--typically after five to ten years of service. In a typical horizontal tube heater, the replacement of the tube and/or supports is an onerous task.

For example, U.S. Pat. No. 3,384,053, to Fleischer, teaches a doublefired heater with an offset chimney. A tube coil is top-supported by hinged supports, which are suspended from the heater structural framework and extend into the heater through small openings through the heater roof. The openings are preferably closed around the support with cement. The heater taught by Fleischer appears to suffer from the same tube-replacement drawbacks as most horizontal tube heaters. Traditionally, the horizontal lengths of tube have to be cut into sections and removed longitudinally, one section at a time, through a door in a furnace end wall. The sectioning, lowering and removal of tube lengths located at higher elevations in the heater can be difficult and somewhat hazardous. Also, the replacement tube has to be inserted into and assembled inside the furnace in a similar manner. Further, because it has not been practical to replace the tube supports without dismantling the tube or cutting apart the tube support, the task is still onerous even if only a tube support needs replacement.

Attempts have been made to provide a removable end wall through which the entire tube coil panel can be removed on slides or rails. These attempts have generally proven to be costly and impractical. One such attempt is illustrated in U.S. Pat. No. 2,456,787, to Kniel. This patent illustrates a heater, designed not to employ a convection section, in which one tube coil is double-fired and two peripheral coils are single-fired (i.e., exposed to flame on one side only) in a furnace chamber. A pair of exhaust ducts extend from the furnace chamber roof. The double-fired tube coil is supported in the chamber by coil supports, through which horizontal lengths of the tube coil extend. The coil supports suspend from a longitudinal track (located above the furnace chamber between the exhaust ducts) down through a slot (parallel to the track) in the furnace chamber roof and into the furnace chamber. The roof slot is normally closed around the supports by hinged closures, the inner surfaces of which are formed of refractory material. Another slot, which is also normally closed by a hinged closure with a refractory inner surface, is provided in the end wall. When the roof slot and end-wall slot closures are opened, the coil can be removed or inserted through the end-wall slot by moving the support along the track. This is a complex arrangement, requiring large openable closures in both the roof and end wall, as well as structure extending well past the furnace chamber end wall to support the track that carries the coil as it is removed through the end wall. Further, no provision is made for interchangeability of the tube supports independently of the tube coil.

Mention should be made of another class of double-fired heaters, referred to herein as "vertical tube heaters," which utilize tubes arranged in vertical lengths instead of horizontal. The construction features, applications and maintenance needs of vertical tube heaters are quite different from horizontal tube heaters, and, therefore, much of the discussion herein will not apply to vertical tube heaters. For example, in most vertical tube heaters, the vertical tube lengths are supported individually from outside the radiant section by a system of linkages and counterweights. Generally, no support members are employed within the radiant section of the heater. As with horizontal tube heaters, however, the vertical lengths are typically longitudinally inserted and removed. Due to the orientation of the tube lengths, they are typically inserted and removed through small openings provided in the roof of the radiant section. Some examples are illustrated in U.S. Pat. Nos. 3,230,052 and 3,265,043, both to Lee, et al.; 3,348,923, to Demarest; and 4,955,323, to Ziemianek. No provision is made in any of these patents for insertion and removal of multiple tube lengths as a unit. Obviously, with no in-radiant-section tube support, there is also no provision for interchanging such a support independently of the tube.

Accordingly, there is a need in the art for a horizontal tube heater in which provision is made for simplified removal and replacement of a worn tube coil panel.

There is a further need in the art for a horizontal tube heater in which the coil panel can be removed as a unit, and a replacement coil panel can similarly be inserted as a unit.

There is a still further need for a horizontal tube heater in which a tube support can be removed and replaced independently of the coil panel itself.

SUMMARY OF THE INVENTION

My invention addresses the foregoing needs in the art by providing a horizontal tube heater in which the tube coil panel can be removed and replaced as a unit, and in which the tube supports preferably can be individually and independently removed and replaced.

In one aspect, my invention relates to a heater which includes a radiant section having a wall and a roof, the roof having a longitudinal opening. A radiant heat exchange tube is disposed in the radiant section, and the tube has an inlet and outlet through which a process fluid can be carried respectively into and out of the radiant section. The tube between the inlet and outlet is arranged in generally horizontal tube lengths. A plurality of burners is provided, at least two of the burners being disposed on opposing sides of the tube. A plurality of tube supports are releasably positioned at longitudinal intervals along the tube lengths and define tube seats on which the tube lengths rest. The tube and tube supports are liftable as a unit through the longitudinal opening of the roof of the radiant section.

Preferably, the tube lengths are substantially parallel and substantially aligned vertically, and each tube support includes a generally vertical stanchion. The tube lengths are also preferably substantially aligned with the longitudinal opening of the roof of the radiant section.

Each tube support can include a generally vertical stanchion and a plurality of support arms, the support arms defining the tube seats and being releasably fastened to the stanchion.

Preferably, the tube supports are releasably suspended within the radiant section from above the tube lengths. Each tube support can be laterally restrained below the tube lengths. In one embodiment, each tube support has an upper end which extends through the longitudinal opening of the roof. Each tube support can further include a shoulder affixed to the upper end of the stanchion so as to be located above the radiant section, wherein the tube support is suspended from the shoulder. A bridge support member can be removably secured across the longitudinal opening of the roof of the radiant section, wherein the shoulder seats on the bridge support member in order to suspend the tube support.

The heater can include a convection section containing a convective heat exchange tube. The convection section is typically above and offset horizontally from the tube.

In one embodiment, the heater includes a pair of the radiant sections; a pair of the tubes, one tube disposed in each radiant section; a pair of sets of the burners, one set of burners being disposed in each radiant section; a pair of sets of the tube supports, one set of tube supports being disposed in each radiant section; and a pair of convection sections, each convection section being operatively connected to a different one of the radiant sections and located above and offset horizontally from the tube disposed in the connected radiant section, the pair of convection sections being disposed adjacent to one another.

In another aspect of my invention, a heater includes a radiant section having a wall and a roof, the roof having a longitudinal opening. A radiant heat exchange tube is disposed in the radiant section. The tube has an inlet and outlet through which a process fluid can be carried respectively into and out of the radiant section. The tube between the inlet and outlet is arranged in generally horizontal tube lengths, and the tube lengths are substantially parallel and aligned vertically to form a coil panel that is generally aligned with the longitudinal opening of the roof of the radiant section. A plurality of burners, at least two of which are disposed on opposing sides of the coil panel, are provided. A plurality of tube supports are releasably positioned at longitudinal intervals along the tube lengths. The tube supports include generally vertical stanchions and support arms extending from the stanchions, wherein the tube lengths rest on the support arms so that the tube support supports the coil panel. The coil panel and tube supports are liftable as a unit through the longitudinal opening of the roof of the radiant section.

These and other objects, features and advantages of my invention will be more apparent from the following detailed description with reference to the appended drawings, in which like reference numerals indicate like elements throughout.

DETAILED DESCRIPTION OF THE PREFERRED EMBODIMENTS

Figure 1:
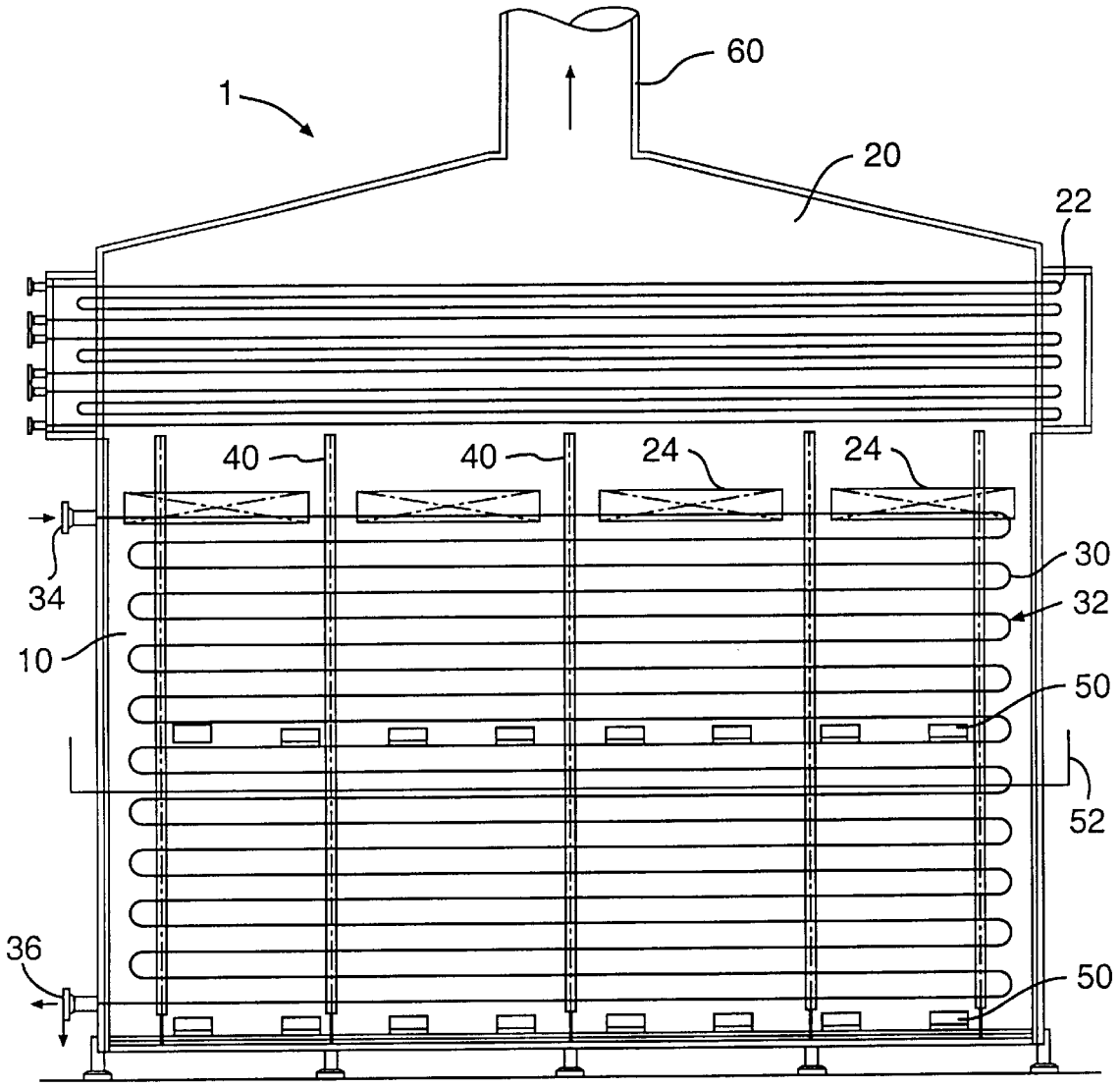
FIG. 1 is a schematic sectional front elevation of a horizontal tube heater according to a preferred embodiment of my invention.

My invention will be discussed in the context of an EDC cracking furnace. However, the principles of my invention are equally applicable to other horizontal tube heater configurations. FIG. 1 is a schematic sectional front elevation of such an EDC cracking furnace 1. The furnace 1 has a radiant section 10 and, in a preferred embodiment, a convection section 20.

At least one heat exchange tube 30 forms a coil panel 32 which winds in horizontal lengths back and forth through the radiant section 10. The coil panel 32 is supported within the radiant section 10 by a plurality of tube supports 40, which are spaced along the horizontal lengths of the tube 30 and define tube seats on which the tube 30 rests. The radiant section tube 30 carries a process fluid (i.e., liquid or gas) from its inlet 34 to its outlet 36 through the radiant section 10. In the illustrated embodiment, the tube inlet 34 is located above the tube outlet 36. However, the principles of my invention apply equally to other arrangements, such as bottom-to-top process fluid flow.

The radiant section 10 also includes a plurality of burners, some of which are preferably elevated on a burner platform. The burners, provided on either side of the coil panel 32, heat the coil panel 32 (and the process fluid flowing through the radiant section tube 30).

The convection section 20 of the furnace 1 is employed downstream (in terms of combustion gases) of and at a higher elevation than the radiant section 10. In the convection section 20, a set of convective tube coils 22 is exposed to a flow of hot exhaust from combustion in the radiant section 10. The exhaust flows out of the convection section 20 via stack 60.

Figure 2:
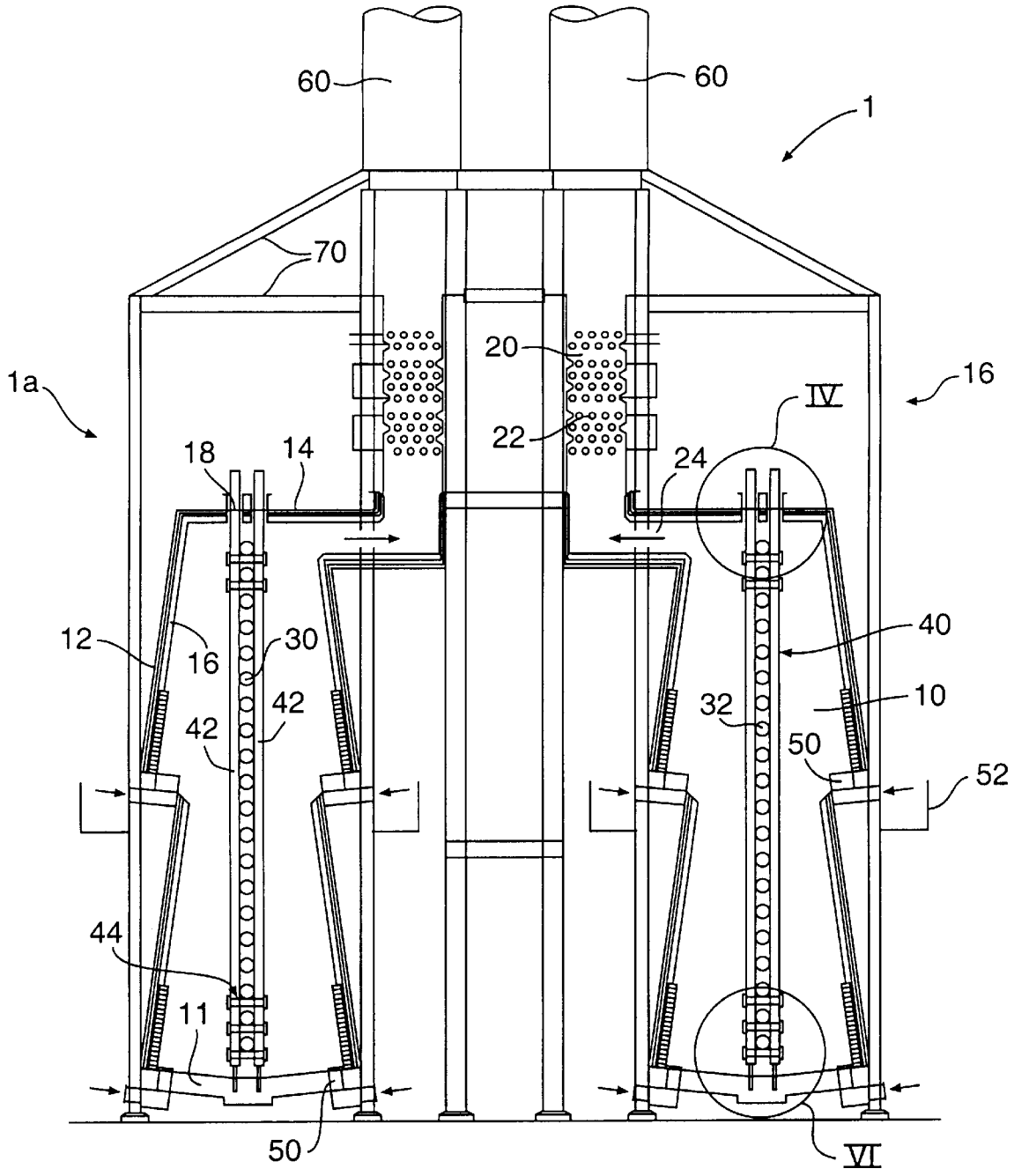
FIG. 2 is a schematic sectional side elevation of the horizontal tube heater illustrated in FIG. 1.

FIG. 2, a schematic sectional side elevation of the furnace 1 illustrated in FIG. 1, shows that the radiant section 10 includes a bottom 11, walls 12 and a roof 14, all of which are lined with suitable refractory material 16. It can be seen that this embodiment of the furnace 1 actually comprises two substantially identical furnaces 1*a*, 1*b*, arranged back-to-back. The benefits of this arrangement will be discussed later.

As can be seen in FIG. 2, the horizontal radiant tube 30 lengths are "stacked" substantially vertically in the coil panel 32. If the furnace 1 employs a convection section 20, as in the illustrated embodiment, the convection section 20 is offset horizontally from the coil panel 32. A longitudinal opening 18, through which the coil panel 32 can fit vertically as a unit, is provided in the roof 14 of the radiant section 10. This combination of features permits the coil panel 32 to be installed or removed as a prefabricated unit through the longitudinal opening 18 in the roof 14 of the radiant section 10.

In order to further facilitate coil removal/insertion, any structural bracing 70 that is located above the radiant section 10 is removably fastened (i.e., bolted, pinned, or the like) in place. This permits the removal of the structural bracing 70 during coil panel 32 insertion/removal. Because the coil panel 32 insertion/removal will not be carried out either during furnace 1 operation or during severe weather, the furnace 1 will not be compromised by the temporary removal of the bracing 70.

Preferably, the tube supports 40 are suspended from above. Because the tube coil panel 32 is top-supported, it is a relatively straightforward operation to transfer the weight of the tube coil panel 32 to a crane or other lifting mechanism. Thus, this top-supported design is well suited for installation and removal of the tube coil panel 32 as a unit in a substantially vertical direction through the longitudinal opening 18. As a practical matter, because the tube supports 40 are top supported, the most efficient manner to lift and remove the coil panel 32 is by utilizing the tube supports 40. Thus, the tube supports 40 and coil panel 32 can be prefabricated and installed as a unit through the longitudinal opening 18 in the radiant section roof 14. Of course, the longitudinal opening 18 must be sized to accommodate such a coil panel assembly.

In addition to the foregoing, the top-supported construction of the tube supports 40 provides additional advantages. One major advantage arises from the principle that the same weight can be supported by a column having a much smaller cross section if that column is in tension rather than compression. Thus, top-supported tube supports 40 can be reduced significantly in size, yet with increased durability, in comparison to comparable supports that are bottom-supported. Given the expense of the high alloy steels that must be used in the radiant section 10 of such a furnace 1, the reduced cross section and increased lifetime of the tube supports 40 can lead to significant cost savings. In addition, the reduced size and weight of the tube supports 40 further facilitates installation and removal of the coil panel 32 through the longitudinal opening 18.

An additional preferable feature of my invention is that the tube supports 40 should be constructed, as described below, so as to permit one of the tube supports 40 to be removed and replaced through the longitudinal opening 18 while leaving the coil panel 32 in place in the radiant section 10 of the furnace 1. This will greatly reduce the time and expense incurred in replacing a worn tube support 40. Because the tube supports 40 are by design redundant (i.e., able to carry the load of the coil panel 32 in the event of failure of any one of the tube supports 40), the coil panel 32 can temporarily be supported by the remaining tube supports 40 while one tube support 40 is removed and replaced.

Each tube support 40 preferably comprises at least one vertical stanchion 42, from which extends a plurality of support arms 44 that define the tube seats on which the tube 30 lengths of the coil panel 32 are supported. The stanchion 42 can take any suitable form, well known in the art, such as an I-beam, C-channel, or the like, but is preferably tubular in shape, and is most preferably centrifugally cast, so as to better maintain structural integrity and strength in the severe furnace conditions. The arms 44 are preferably removably attached to the stanchion 42. By detaching the arms 44 from the stanchions 42, the stanchions 42 can be lifted straight up through the longitudinal opening 18 in the roof 14 of the radiant section 10 without disturbing the coil panel 32. This permits the stanchions 42 to be individually removed and replaced while leaving the coil panel 32 intact and in place in the furnace 1.

Figure 4:
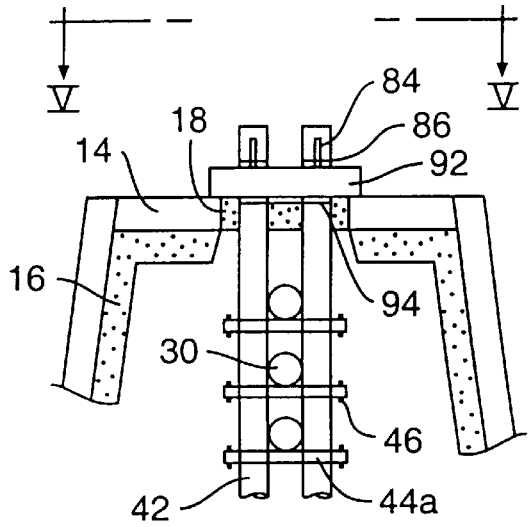
FIG. 4 is a detailed view of the area indicated by circle IV in FIG. 2.

One embodiment of the tube support 40 is shown in FIGS. 2 and 4. A pair of parallel, tubular stanchions 42 is disposed on either side of and supports a single coil panel 32. A plurality of rungs 44*a*, extending between the stanchions 42, bears the weight of the coil panel 32. (FIG. 2 only illustrates the rungs 44*a* at the top and bottom of the stanchions 42, but in actuality the rungs 44*a* will be employed along the entire length of the stanchions 42.) The rungs 44*a* can take any suitable form, such as solid rectangular bars or hollow tubes, but are preferably solid round bars.

Depending upon the type of furnace 1 and the temperatures that will be encountered, the stanchions 42 and rungs 44*a* are formed of suitable materials. In the case of an EDC cracking furnace 1, the stanchions 42 (and preferably the rungs 44*a*) should be formed of steel alloy containing chrome and/or nickel, preferably at least 25% chrome and/or 20% nickel. One suitable alloy is HK40, an austenitic stainless steel. Other materials, well known to those in the art, having like or superior thermal strength properties can be employed. In applications having more severe temperature or load conditions, higher alloys may be required. The thicknesses of the stanchions 42 and rungs 44*a* will depend upon such factors as the height and weight of the coil panel 32, and can be readily determined by those in the art.

Preferably, the rungs 44*a* are removably attached to the stanchion 42. In the illustrated embodiment, each rung 44*a* extends through opposing holes in each stanchion 42. Cotter pins 46, for example, can be provided at each end of the rung 44*a* to maintain it in place. The rungs 44*a* can be fastened to the stanchions 42 in other ways, such as threaded nuts or welded washers. As noted, providing removably attached rungs 44*a* permits the stanchions 42 to be individually removed and replaced through the longitudinal opening 18 in the roof 14 of the radiant section 10 without removing or dismantling the coil panel 32.

Figure 3:
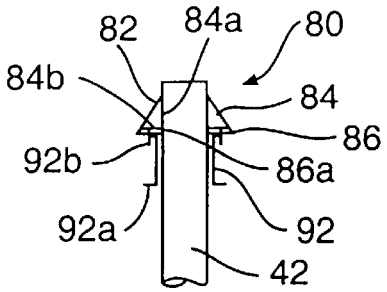
FIG. 3 is a detail of a stanchion top support mechanism according to an embodiment of my invention.
Figure 5:
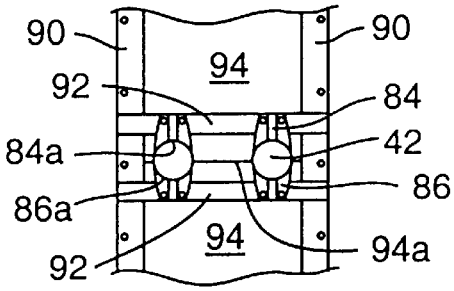
FIG. 5 is a detailed view indicated by arrows V—V in FIG. 4.

As noted above, the stanchions 42 are preferably suspended from above. It is preferred that whatever structure is employed for primary load-bearing support be located outside the radiant section 10, because the high temperatures in the radiant section 10 can lower the yield strength of the materials used to bear the load. It is also preferred that the stanchions 42 be supported in a manner that permits withdrawal of the coil panel 32 and/or stanchions 42 when desired. Thus, I prefer that each stanchion 42 in operation extend out through the longitudinal opening 18 through which the coil panel 32 can be removed, and that the primary load-bearing support of the stanchion 42 be provided on the portion of the stanchion 42 that is above the longitudinal opening 18. FIGS. 3–5 illustrate a preferred arrangement for achieving this.

A shoulder 80 is affixed to the stanchion 42 at or near its upper end.

The shoulder 80 should extend transversely in at least two, opposing directions from the stanchion 42. The shoulder 80 can take many forms, such as a collar or pin at the end of the stanchion 42, but in the preferred embodiment the shoulder 80 is a pair of opposing lug assemblies 82 that are welded to the stanchion 42. In the embodiment shown in FIGS. 3–5, each lug assembly 82 comprises a vertical stiffener 84 and a horizontal plate 86 at the base of the stiffener 84. The illustrated vertical stiffener 84 is a triangular plate, two edges 84*a*, 84b of which are welded to the stanchion 42 and the horizontal plate 86, respectively. The horizontal plate 86 has a radius edge 86a that is also welded to the stanchion 42.

A support surface, on which the stanchion shoulder 80 seats, is provided on the furnace 1. The support surface can be provided by rails 90 that define the edges of the longitudinal opening 18 through which the stanchion 42 extends. However, the rails 90 are far enough apart so that longitudinal opening 18 is wide enough to permit the entire coil panel assembly (i.e., the coil panel 32 and stanchions 42) to pass therethrough. Thus, if the rails 90 were to provide the support surface, the shoulder 80 would have to be able to support the stanchion 42 (and coil panel 32 carried thereby) through a considerable moment arm. Therefore, it is preferred that the support surface be provided closer to and on each side of the stanchion 42. This can be accomplished by bridge support members 92 that traverse the longitudinal opening 18 on either side of the stanchion 42. In the preferred embodiment, each bridge support member 92 is a C-shaped channel, open away from the stanchion 42. One leg 92*a* of the channel rests on the rails 90 at either edge of the longitudinal opening 18, and the opposite leg 92*b* of the channel provides the support surface for the lug assemblies 82.

Figure 6:
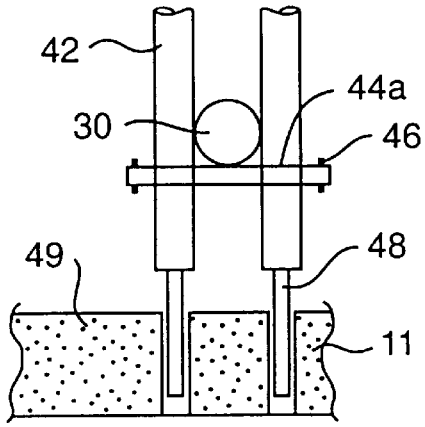
FIG. 6 is a detailed view of the area indicated by circle VI in FIG. 2.

During operation of furnace 1, the coil panel 32 will expand and contract as the temperature changes, causing local longitudinal movement of the tubes 30 relative to the stanchions 42. In order to stabilize the coil panel 32 and prevent sudden, damaging skipping or binding, the stanchions 42 are preferably laterally fixed at their top and bottom. At their top, this can be accomplished by bolting the lug assemblies 82 to the bridge support members 92, and bolting the bridge support members 92 to the rails 90. At their bottom, the stanchions 42 can be held steady by guide pins 48 that fit into tubular guide holes 49 at the bottom 11 of the radiant section 10 of the furnace 1, as shown in FIG. 6. The guide pins 48 are free to slide longitudinally in the guide holes 49, thereby permitting thermal expansion and contraction while restraining horizontal movement. This arrangement also readily permits the stanchions 42, either carrying or separated from the coil panel 32, to be lifted away from the bottom of the furnace 1.

Because it is preferred that the stanchions 42 be restrained laterally as the tubes 30 expand and contract, the relative movement of the tubes 30 will impart frictional forces on the tube supports 40. The materials and thicknesses of the tube supports 40 should be selected so as to withstand these frictional forces, as will be readily apparent to those in the art.

Although it is not necessary to provide an airtight seal of the longitudinal opening 18 during furnace operation, it is preferable to minimize airflow through the longitudinal opening 18 to maintain furnace efficiency. This can be accomplished by a series of closure plates 94 with insulated undersides. A pair of closure plates 94 are shaped to fit around each tube support 40, and can be spliced together by any suitable means, such as bolting flat bars across their interface 94*a*. The closure plates 94 can be bolted to the underside of the bridge support members 92.

The lug assemblies 82, bridge support members 92, and closure plates 94 can all be formed of suitable structural steel, such as ASTM A36 structural carbon steel. The lug assemblies 82, which carry the primary weight-bearing responsibility, can be formed of stronger materials, such as 1 ¼ or 2 ¼ chrome steel, if weight or temperatures so dictate, as will be apparent to those in the art.

Figure 8:
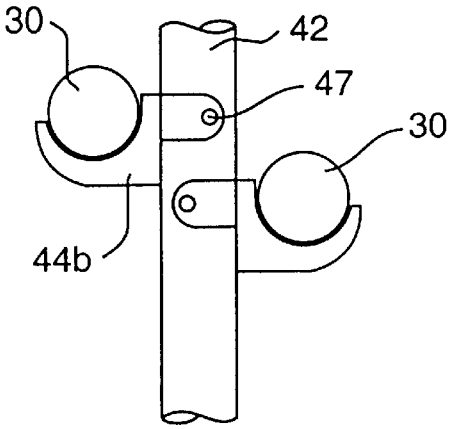
FIG. 8 is a detailed view of the area indicated by circle VIII in FIG. 7.
Figure 7:
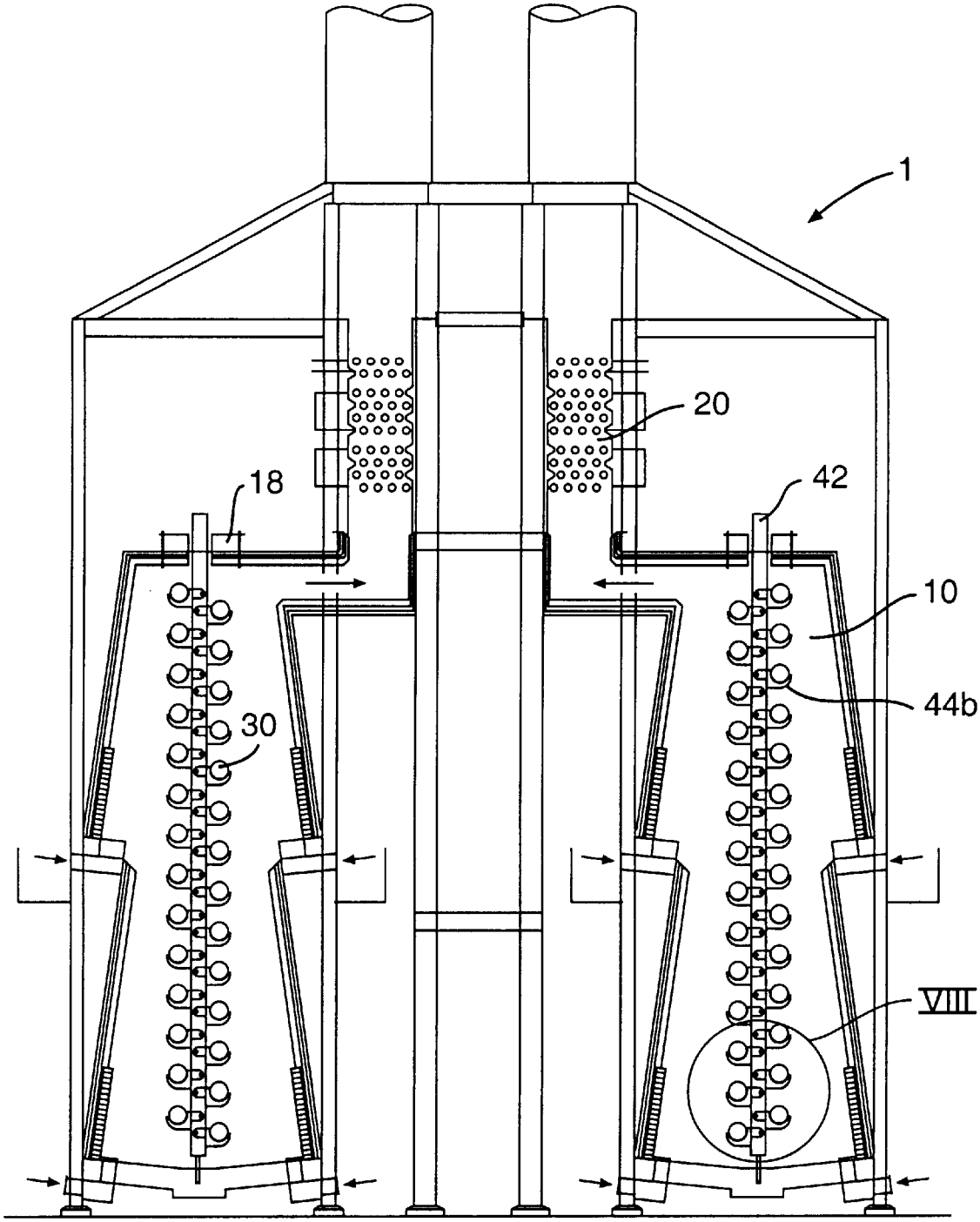
FIG. 7 is a schematic sectional side elevation of a horizontal tube heater according to another embodiment of my invention.

In another embodiment, shown in FIGS. 7 and 8, the tube support 40 comprises a single stanchion 42, formed similarly to the previous embodiments, sandwiched between and supporting a pair of coil panels 32 (a so-called "double-pass" arrangement). In the tube supports 40 shown in FIGS. 7 and 8, two series of cast hooks 44*b* are mounted to opposing sides of the stanchion 42 to bear the weight of the coil panels 32. As with the rungs 44*a* of the previous embodiment, the hooks 44*b* should be removably attached to the stanchion 42. For example, a hook 44*b* can either fit around or into the stanchion 42, and be pinned in place by a pin 47 that passes completely through both the hook 44*b* and the stanchion 42.

Cotter pins (not shown), for example, can be provided at one or both ends of the pin 47 to maintain it in place.

The remaining features of the tube support 40, discussed above in connection with the embodiments illustrated in FIGS. 2–6, apply to this embodiment as well.

As noted, the convection section 20 is offset from the radiant coil panel 32. The convection section 20 should be offset at least far enough to permit the coil panel 32 and/or stanchions 42 to be inserted and removed through the longitudinal opening 18 without impinging upon the convection section 20. As a practical matter, it is preferred that the convection section 20 be offset totally from the radiant section 10, as shown in FIG. 2. In such an arrangement, the convection section 20 is connected to the radiant section 10 by crossover ducts 24. In addition to aiding the flow of exhaust into the convection section 20, this arrangement facilitates individual modular construction and assembly of the convection and radiant sections 20, 10.

An optional, and independent, aspect of the invention that is particularly applicable to larger capacity operations is also illustrated in FIGS. 2 and 7. Two substantially identical furnaces la, lb are arranged back-to-back and can be operated in parallel. This is particularly useful in constructing furnaces 1*a*, 1*b* employing an offset convection section 20. By orienting the furnaces 1*a*, 1*b* with respective convection sections 20 adjacent to one another, the furnaces 1*a*, 1*b* can structurally stabilize one another. This permits less structural steel to be used in each furnace 1*a* or 1*b* than if it were standing alone.

This dual furnace arrangement has a major advantage in processes such as EDC cracking, in which the furnaces must be periodically taken off-line and decoked. By providing operationally independent units, as opposed to some conventional furnaces having separate radiant sections but a shared convection section, one furnace can be operated when the other is taken off-line for decoking or the like.

It is also preferred that a Terrace Wall™ construction, evident in FIGS. 2 and 7, be employed in the furnace 1. The details of this construction are set forth in U.S. Pat. Nos. 3,230,052, 3,265,043, 3,302,621, 3,348,923 and 4,955,323, each of which is incorporated by reference herein in its entirety. This construction provides several benefits. The burners mounted on the burner platform fire upward toward the sloped refractory radiant section wall 12, providing uniform and symmetrical heating to the radiant coil panel 32. This uniform heating decreases the formation of coke in the coil panel 32, which in turn increases the service life of the coil panel 32. The absence of flames directly impinging on the tube 30 also extends service life of coil panel 32. Additionally, fewer burners are required than in a flat wall furnace, resulting in easier startup and maintenance. This also reduces the cost of employing "zoned" firing, which is advantageous to EDC cracking, and combustion air ducts for forced draft operations, which also improves operating cycle lifetimes. This further results in fewer burner rows, which simplify the arrangement of burner platforms and, therefore, facilitate access for maintenance or the like.

Referring again to the embodiment illustrated in FIGS. 2–6, I will describe an exemplary operation for removing the coil panel 32. Initially, the removable bracing 70 and the closure plates 94 are unbolted and removed. The lug assemblies 82 are unbolted from the bridge support members 92, so that the lug assemblies 82 still bear the weight of the tube supports 40 and coil panel 32 but rest freely on the bridge support members 92. At this point, the stanchions 42 and/or coil panel 32 are rigged to a crane or the like, and lifted slightly so as to remove the load from the bridge support members 92. The bridge support members 92 are then unbolted and removed, and the coil panel 32 and tube supports 40 can then be lifted out through the longitudinal opening 18.

In order to remove a stanchion 42 but not the coil panel 32, the rungs 44*a* are unpinned and removed from the stanchion 42. If necessary, the lug assemblies 82 can first be unbolted from the bridge support members 92, and some of the stanchions 42 (but not the one being removed) and/or the coil panel 32 can be rigged to a crane or the like and lifted slightly so as to remove the load from the rungs 44*a* of the stanchion to be removed 42. Once the rungs 44*a* are unpinned and removed from the stanchion 42, the stanchion 42 can be lifted out through the longitudinal opening 18 with the closure plates 94 and bridge support members 92 still in place.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

I claim:

1. A heater comprising:

a radiant section having a wall and a roof, the roof having a longitudinal opening;

a radiant heat exchange tube disposed in the radiant section, the tube having an inlet and outlet through which a process fluid can be carried respectively into and out of the radiant section, the tube between the inlet and outlet being arranged in generally horizontal tube lengths;

a plurality of burners, at least two of the burners being disposed on opposing sides of the tube; and a plurality of tube supports releasably positioned at longitudinal intervals along the tube lengths, the tube supports defining tube seats on which the tube lengths rest, the tube and tube supports being liftable as a unit through the longitudinal opening of the roof of the radiant section.

2. The heater according to claim 1, wherein the tube lengths are substantially parallel and substantially aligned vertically, and each tube support includes a generally vertical stanchion.

3. The heater according to claim 2, wherein the tube lengths are substantially aligned with the longitudinal opening of the roof of the radiant section.

4. The heater according to claim 1, wherein each tube support comprises a generally vertical stanchion and a plurality of support arms, the support arms defining the tube seats and being releasably fastened to the stanchion.

5. The heater according to claim 1, wherein the tube supports are releasably suspended within the radiant section from above the tube lengths.

6. The heater according to claim 5, wherein each tube support is laterally restrained below the tube lengths.

7. The heater according to claim 5, wherein each tube support has an upper end that extends through the longitudinal opening of the roof.

8. The heater according to claim 7, wherein each tube support further comprises a shoulder affixed to the upper end of the stanchion so as to be located above the radiant section, and wherein the tube support is suspended from the shoulder.

9. The heater according to claim 8, further comprising a bridge support member removably secured across the longitudinal opening of the roof of the radiant section, wherein the shoulder seats on the bridge support member in order to suspend the tube support.

10. The heater according to claim 1, further comprising a convection section containing a convective heat exchange tube, the convection section being above and offset horizontally from the tube.

11. The heater according to claim 1, comprising a pair of the radiant sections; a pair of the tubes, one tube disposed in each radiant section; a pair of sets of the burners, one set of burners being disposed in each radiant section; a pair of sets of the tube supports, one set of tube supports being disposed in each radiant section; and a pair of convection sections, each convection section being operatively connected to a different one of the radiant sections and located above and offset horizontally from the tube disposed in the connected radiant section, the pair of convection sections being disposed adjacent to one another.

12. A heater comprising:

a radiant section having a wall and a roof, the roof having a longitudinal opening;

a radiant heat exchange tube disposed in the radiant section, the tube having an inlet and outlet through which a process fluid can be carried respectively into and out of the radiant section, the tube between the inlet and outlet being arranged in generally horizontal tube lengths, the tube lengths being substantially parallel and aligned vertically to form a coil panel that is generally aligned with the longitudinal opening of the roof of the radiant section;

a plurality of burners, at least two of the burners being disposed on opposing sides of the coil panel; and a plurality of tube supports releasably positioned at longitudinal intervals along the tube lengths, the tube supports comprising generally vertical stanchions and support arms extending from the stanchions, wherein the tube lengths rest on the support arms so that the tube support supports the coil panel, the coil panel and tube supports being liftable as a unit through the longitudinal opening of the roof of the radiant section.

13. The heater according to claim 12, wherein the tube supports are releasably suspended within the radiant section from above the coil panel.

14. The heater according to claim 13, wherein each tube support is laterally restrained below the coil panel.

15. The heater according to claim 13, wherein each tube support has an upper end that extends through the longitudinal opening of the roof.

16. The heater according to claim 15, wherein each tube support further comprises a shoulder affixed to the upper end of the stanchion so as to be located above the radiant section, and wherein the tube support is suspended from the shoulder.

17. The heater according to claim 16, further comprising a bridge support member removably secured across the longitudinal opening of the roof of the radiant section, wherein the shoulder seats on the bridge support member in order to suspend the tube support.

18. The heater according to claim 12, further comprising a convection section containing a convective heat exchange tube, the convection section being above and offset horizontally from the tube.

19. The heater according to claim 12, comprising a pair of the radiant sections; a pair of the tubes, one tube disposed in each radiant section; a pair of sets of the burners, one set of burners being disposed in each radiant section; a pair of sets of the tube supports, one set of tube supports being disposed in each radiant section; and a pair of convection sections, each convection section being operatively connected to a different one of the radiant sections and located above and offset horizontally from the tube disposed in the connected radiant section, the pair of convection sections being disposed adjacent to one another.

* * * * *